US007701137B2

(12) United States Patent
DiSanto et al.

(10) Patent No.: US 7,701,137 B2
(45) Date of Patent: Apr. 20, 2010

(54) APPARATUS FOR EVACUATING A FIELD EMISSION DISPLAY

(75) Inventors: Frank DiSanto, Melville, NY (US); Denis Krusos, Melville, NY (US)

(73) Assignee: Copytele, Inc., Melville, NY (US)

( * ) Notice: Subject to any disclaimer, the term of this patent is extended or adjusted under 35 U.S.C. 154(b) by 154 days.

(21) Appl. No.: 11/704,173

(22) Filed: Feb. 8, 2007

(65) Prior Publication Data

US 2008/0231183 A1 Sep. 25, 2008

(51) Int. Cl.
*H01J 17/24* (2006.01)
*H01J 9/38* (2006.01)

(52) U.S. Cl. ..... 313/553; 313/495; 313/546

(58) Field of Classification Search ..... 313/553–562, 313/495–497

See application file for complete search history.

(56) References Cited

U.S. PATENT DOCUMENTS 5,965,978 A * 10/1999 Kishino et al. ..... 313/496
5,984,748 A * 11/1999 Ritter et al. ..... 445/24
6,084,344 A 7/2000 Kishino et al.
2005/0168131 A1* 8/2005 DiSanto et al. ..... 313/497
2007/0228928 A1* 10/2007 Min et al. ..... 313/495

* cited by examiner

*Primary Examiner*—Toan Ton
*Assistant Examiner*—Nathaniel J Lee
(74) *Attorney, Agent, or Firm*—Plevy + Keene LLP

(57) ABSTRACT

A vacuum container comprising: a first and second substrate of relatively the same dimensions and areas, a peripheral seal positioned about the outer periphery of each substrate for bonding the first substrate to the second substrate to form a composite stacked member; and a getter box having a vacuum aperture in one side with an evacuation tube of a given diameter opening to enclose the vacuum aperture, the tube joined to the box about the opening and having a sealed end remote from the box, the getter box having a getter source in the box hollow to absorb any residual gasses in the display hollow after the display hollow has been evacuated to a desired vacuum before sealing the end of the evacuation tube, wherein the area of the aperture is equal to or greater than $\pi(D/2)^2$ where D is the diameter of the evacuation tube opening.

16 Claims, 5 Drawing Sheets

APPARATUS FOR EVACUATING A FIELD EMISSION DISPLAY

FIELD OF THE INVENTION

This application relates to a hermetically sealed flat panel display maintained at a high vacuum utilizing a getter enclosed in a low profile containment.

BACKGROUND OF THE INVENTION

Flat panel display (FPD) technology is one of the fastest growing display technologies in the world, with a potential to surpass and replace cathode ray tubes (CRTs) in the near future. As a result of this growth, a large variety of FPDs exist, which range from very small virtual reality eye tools to large hang-on-the-wall television displays.

The FPD generally includes a hermetically sealed vacuum container or envelope formed by sealing an anode substrate to a cathode substrate. A display employs phosphors at pixel locations which emit light when energized.

The anode substrate and the cathode substrate of such displays are made of thin glass plates each having a thickness as small as, for example, between 0.5 to 2.5 millimeters (mm) and are spaced from each other at a distance as small as 0.2 mm, resulting in the envelope being highly reduced in thickness. The substrates are rectangular and each of the same size. The substrates can be any size. Viewing areas vary accordingly and can be used as automotive, telephone, computer and other displays requiring small (or large) size and high (or low) resolution and larger sizes for computer and television devices, for example. However, the attachment of devices to insure the evacuation of residual gases in the envelope often compromise the overall thickness of the construction. U.S. Pat. No. 6,084,344 ('344 patent) issued on Jul. 4, 2000 to T. Kishino et al. and entitled "Reduced Thickness Vacuum Container With Getter" and assigned to Futaba Denshi Kogyo K.K. of Japan, describes prior art techniques used to evacuate such displays having anode and cathode substrates. The patent also describes a problem which is inherent in making thin displays. For example, as indicated above, such displays may have a spacing as small as 0.2 millimeters. The evacuation tube which goes to the evacuation pump has an inside diameter which is approximately 2 mm and an outside diameter of 4 mm. Therefore, since the evacuation tube has a diameter (outside) of 4 mm, one cannot easily evacuate the display via the thin bonded sides or the periphery, which sides are bonded by a glass frit joining the anode plate (or substrate) to the cathode plate. This cannot be done because of the fact that if the glass is, for example 0.7 mm in thickness, the entire display including the spacing is about 1.6 millimeters in thickness (0.7 mm cathode+0.7 mm anode+0.2 mm spacing). Therefore, the tube from the pump is of a diameter greater than the thickness of the display. The above-noted '344 patent discloses a first series of solutions that involve putting a through-hole in the cathode or the anode substrate with no hole in the periphery. When placing a hole or aperture in the periphery of the display one had to extend the anode or cathode structure so that one could place a getter box over the display, which getter box as shown in FIG. 8 and FIG. 9 of the '344 patent has an aperture including an internal cavity which contained a getter, and which getter box interfaced with the side surface of the display. In any event, in order to support the getter box, one had to extend either the cathode or the anode plates. This is clearly shown in FIGS. 8, 9, 10 and 11 of the '344 patent. FIGS. 12 and 13 of the '344 patent also show apertures in the periphery of the device, with the aperture communicating with the getter box, which again requires an extension of either the cathode or the anode. In that patent, the evacuation is always transverse to the cathode and anode plates thereby significantly increasing the thickness. In order to insure that the FPD functions reliably, the envelope formed by the anode and cathode must be evacuated of all gases. Typical evacuation is in a range between $10^{-5}$ and $10^{-6}$ Torr so that the displays emit electrons with great efficiency. However, one can see also from the above noted patent, this creates a problem and requires extending the anode or cathode substrate to accommodate the getter box.

The present invention involves placing a getter box at the sides or periphery of the display, which getter box is attached to the periphery of the display without the need to extend the cathode or anode substrate.

SUMMARY OF THE INVENTION

According to an aspect of the present invention, a vacuum container is formed from two substrates arranged opposite to each other, spaced from each other at a predetermined distance, and sealed about the periphery. A getter box is attached to the side of the display and a hole (e.g. rectangular) in the periphery of the display is surrounded by the getter box which has a separate aperture for communicating with the evacuation tube while enabling efficient exhaust.

According to another aspect of the invention, a vacuum container comprises: a first and second substrate of relatively the same dimensions and areas, a peripheral seal positioned about the outer periphery of each substrate for bonding the first substrate to the second substrate to form a composite stacked member of a given height with the first substrate bonded to the second substrate with the seal sandwiched between the substrates, the substrates separated one from the other by the width of the seal to create an internal hollow between the substrates, the seal having an elongated aperture between the substrates, a getter box having a top and a bottom surface with a first and a second side joining the top and bottom surfaces, with a front opening of the box having a length greater than the length of the aperture and a width greater than the thickness of the composite member, the box joined to the substrates to cover and enclose the aperture in the seal, the box having a vacuum aperture in one side with an evacuation tube of a given diameter opening to enclose the vacuum aperture, the tube joined to the box about the opening and having a sealed end remote from the box, the getter box having a getter source in the box hollow to absorb any residual gasses in the display hollow after the display hollow has been evacuated to a desired vacuum before sealing the end of the evacuation tube, wherein the area of the aperture is equal to or greater than $\pi(D/2)^2$ where D is the diameter of the evacuation tube opening.

In another aspect of the present invention, an FPD comprises a vacuum envelope formed from a cathode substrate and an anode substrate joined by one or more outer peripheral members that provide at least one access hole to a getter box, and an associated evacuation tube further including within the envelope a plurality of electrically addressable pixels; a plurality of thin-film transistor (TFT) driver circuits each being electrically coupled to an associated at least one of the pixels, respectively; a passivating layer on the thin-film transistor driver circuits and at least partially around the pixels; and, a cathode; wherein addressing one of the pixels using the associated driver circuit causes the cathode to emit electrons that induce the one of the pixels to emit light.

BRIEF DESCRIPTION OF THE DRAWINGS

It is to be understood that the accompanying drawings are solely for purposes of illustrating the concepts of the invention and are not drawn to scale. The embodiments shown in the accompanying drawings, and described in the accompanying detailed description, are to be used as illustrative embodiments and should not be construed as the only manner of practicing the invention.

DETAILED DESCRIPTION OF THE INVENTION

It is to be understood that the figures and descriptions of the present invention have been simplified to illustrate elements that are relevant for a clear understanding of the present invention, while eliminating, for the purpose of clarity, many other elements found in typical FPD systems and methods of making and using the same. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein.

Figure 1A:
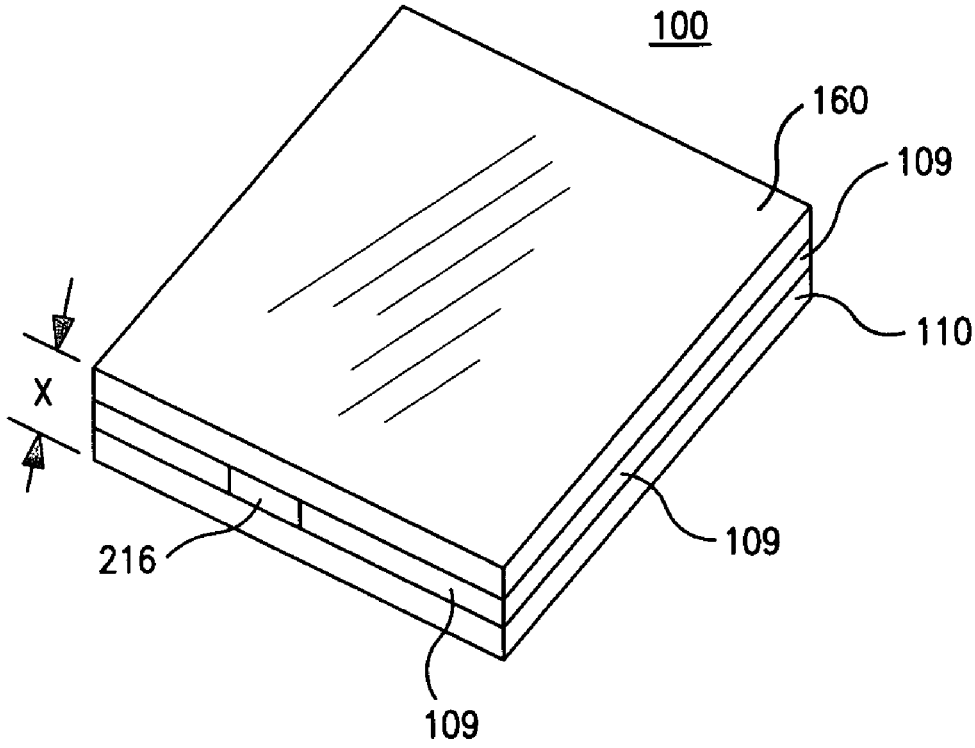
FIG. 1*a* illustrates a perspective view of a display vacuum container showing the top substrates and side members according to an embodiment of the present invention.

Referring to FIG. 1*a* is there is shown a container which constitutes a display container and which container has to be evacuated. The container consists of a first substrate which is normally a glass sheet or plate 160 designated for purposes of explanation as an anode. The anode plate on the inner surface may contain suitable phosphors which can be arranged as fine dots or pixels. Sealed to the anode plate is a cathode substrate or glass plate 110. As Indicated, the cathode, 110, may, for example, contain field emission devices or other devices to activate the phosphors on the anode. In one configuration the two glass substrates operate as anode/cathode substrates respectively for an FPD. In another configuration, such as a nanotube configuration, one of the glass substrates operates as the anode (i.e. no cathode configuration) while the other glass substrate is simply a viewing glass devoid of any components that operates to maintain the vacuum for the structure. Again, it is indicated that there are many types of flat panel displays which are known in the prior art. All such displays must be evacuated and therefore the spacing between the anode and cathode is at a high vacuum to enable efficient display operation. Also shown, is a spacing member 109. Typically spacer 109 consists of a glass seal, which glass seal firmly spaces and separates the anode 110 from the cathode 160. This spacing may be on the order of 0.2 millimeters. The thickness of the anode and cathode plates may vary from between about 0.5 mm to about 2.5 mm. For a preferred display the thickness of the anode substrate 110 and the cathode substrate 160 is about 0.7 mm. Therefore, with the spacing 109 of 0.2 mm, the entire thickness of the display designated by reference numeral x, is 1.6 millimeters. In order to insure that the FPD device functions as a display device, the interior of the envelope 100 which includes the anode substrate 160 and the cathode substrate 110 should be kept at a high vacuum.

For example in the case of a low voltage phosphor display the vacuum permits the field emission cathode to emit electrons which impinge upon the anode at high efficiencies. Such a display should have a vacuum anywhere from $10^{-5}$ Torr to $10^{-6}$ Torr. Spacing 109 is on the order of 0.2 mm. An aperture 216 which is made on a peripheral portion of the display between the anode and the cathode is rectangular and is selected in accordance with the diameter of the evacuation tube. The dimension of the aperture 216 which as seen is rectangular in shape, is selected so that the evacuation pump in conjunction with the evacuation tube can operate to efficiently and quickly evacuate the space between the anode and cathode. Instead of aperture 216 a hole in the side would only be 0.2 mm in diameter. This diameter is unacceptable because of the fact that the exhaust mechanism which includes the exhaust tube cannot and will not be able to create a vacuum due to the small sized aperture.

Figure 1B:
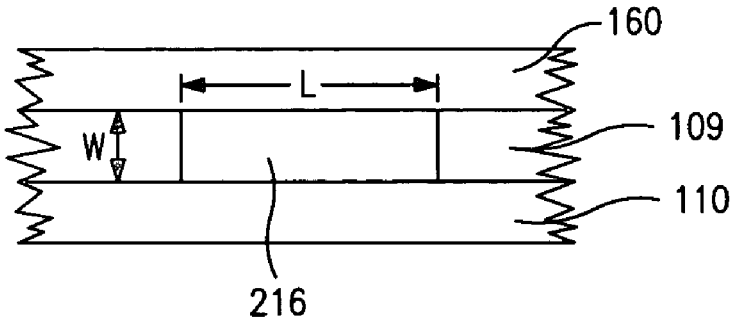
FIG. 1*b* illustrates a side view of a display device showing a getter box and evacuation tube according to an embodiment of the present invention.

FIG. 1*b* shows the partial view of the anode substrate 110 which as indicated is a glass substrate. The cathode substrate 160 which is also a glass substrate is joined or sealed to the anode by spacer member 109 formed of a suitable adhesive such as a low melting glass or a glass frit or other suitable adhesive, which firmly seals the anode 110 to the cathode 160. The aperture 216 is shown. The aperture 216 has a width which again is equal to the width of the spacer 109, and as indicated is 0.2 mm. It also has a length L. The length L is selected as follows. A typical exhaust tube has an inner diameter of 2 mm. This inner diameter is specified because of the exhaust port associated with the exhaust motor which thereby draws air from the spacing in the envelope and produces a vacuum. The exhaust tube has an inner diameter of 2 mm with an outer diameter of 4 mm. The 2 mm diameter specifies an area of exhaust for proper operation. The area of exhaust equals $\pi(D/2)^2$. Therefore, for an outer diameter of 4 millimeters, $\pi(D/2)^2$ is approximately equal to 12 square millimeters. Thus, the aperture 216 would have a length of 60 millimeters (0.2 mm×60 mm=12 sq. millimeters). This area of 12 square millimeters is provided by aperture 216 which therefore enables the pump to evacuate the spacing between the anode and cathode at the appropriate exhaust with the correct air flow.

Figure 1C:
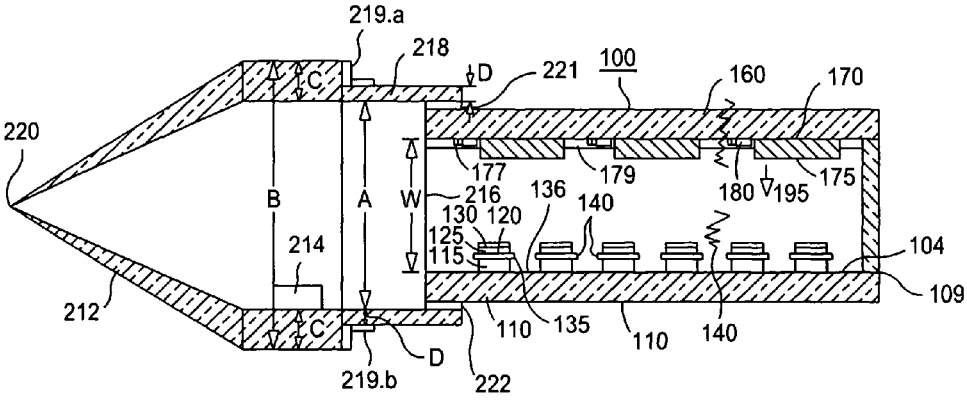
FIG. 1*c* illustrates a cross sectional view Al of a display device showing a getter box and evacuation tube according to an embodiment of the present invention.

FIG. 1*c* illustrates a cross sectional view of one embodiment of the vacuum container 100 housing a TFT anode/cold cathode FPD according to an embodiment of the present invention. In this exemplary embodiment, the FPD includes cathode 104 positioned on the glass substrate 110. The cathode acts as a low-voltage source of electrons. While not shown in this embodiment, it is nevertheless understood that both the cathode and anode may be on the same plate or substrate (such as for example in a nanotube emitter configuration). The glass anode substrate 160 employs TFT circuitry to control the attraction of electrons 140 emitted from the cathode 104. As shown in FIG. 1*a* and FIG. 1*b* the glass anode substrate 160 and cathode substrate 110 are joined by frit glass side or spacer members 109. The glass spacers are preferably each 0.2 mm thick. The anode and cathode substrates are large in area compared to the getter box and therefore broken lines 190 are employed to indicate that the length of the substrates are shown by way of example in FIG. 1*c* but are relatively longer (as above indicated). Vacuum container 100 has an aperture or through-hole 216 formed in one of its side members. To provide the through-hole 216 on any side, the side member may be essentially split into two side member parts each of which is foreshortened to create the access hole in the gap between the members. In the embodiment illustrated in FIG. 1*a* and FIG. 1*b*, the through-hole 216 is formed between the anode substrate and the cathode substrate or on the short side between the side members. In FIG. 1*c*, getter box 218 is then positioned and installed over the through-hole 216 which has a generally rectangular shape formed in the gap. As shown in FIG. 1*b* the through-hole 206 in one example has dimensions of 0.2 mm×60 mm. In turn getter box 218 interfaces with the evacuation tube 212 through the access hole 216.

The evacuation tube 212 is cone-like in geometric shape. The cone shape of the evacuation tube 212 with the apex 220 is formed after the display envelope is evacuated. The evacuation tube has an inner diameter (A) of 2 mm and an outer diameter (B) of 4 mm. The tube is made of glass and is connected at one end to an evacuation pump (not shown). After evacuation to the desired vacuum ($10^{-5}$-$10^{-6}$ Torr) the glass evacuation tube is heated and drawn closed by pulling and compressing as the glass becomes molten, hence forming the conical like shape. In the embodiment shown, the through-hole 216 is arranged at a left side end portion of the peripheral seal joining the glass members. It is recognized that the through-hole 216 may be formed on any one of the four sides of the vacuum container 100.

As indicated, the through-hole 216 functions as a port through which the gas (i.e., air) in container 100 is withdrawn under pressure from the external pump, through the evacuation tube 212 and discharged. After the pump has discharged the air content to a particular low level, the getter 214 (after activation) substantially absorbs the gas remaining in the container 100. Getters are typically composed of materials of the non-vaporization type such as Ti—Zr—Al alloy, Ti—Zr—V—Fe alloy or any material of the vaporization type such as Ba—Al alloy. In each of the embodiments described herein, the getter 214 is arranged on a side of the getter box 218. Multiple getters may be installed and arranged in the getter box 218 depending on the requirements for the particular FPD. Furthermore, the getter 214 may be formed into any suitable shape such as a pill-like cylinder, bar, or ring-like member, provided it can be housed in the getter box 218. In FIG. 1*c* for a typical display the width (w) of the aperture 216 is 0.2 mm. The dimension A which is the inner diameter of the evacuation tube is 2 mm. As seen the getter box and tube are joined together by glass frits. There is shown "L" shaped supports 219.*a* and 219.*b* which secure the evacuation tube to the sides of the getter box 218. The outer diameter B of the evacuation tube as shown is 4 mm and therefore the wall thickness C is 1 mm. The thickness of the getter box walls D is 1 mm. Glass frit seals 221 and 222 secure the getter box to the anode and cathode substrates. Since all these components are glass, joining and sealing them, as shown, is easily implemented. The thickness of the space seals 221 and 222 (and corresponding glass frit) is based on the difference between the thickness of the display and the getter box width "A" (FIG. 1*c*).

Anode substrate 160 includes a plurality of conductive pads 170 fabricated in a matrix of substantially parallel rows and columns on substrate 160 using known fabrication methods. Column conductors 177 are associated with each of the corresponding conductive pads 170. In this illustrated embodiment substrate 160 is a transparent material such as glass. Conductive pads 170 are also composed of a transparent material, such as Indium Titanium Oxide (ITO). The getter box 218 and the envelope 100 are also fabricated from a material such as glass. It is of course recognized that the pixels may range from opaque to transparent according to the desired application and/or viewing perspective.

Deposited on each conductive pad 170 is phosphor layer 175. Phosphor layer 175 may be selected from materials that emit light 195 of a specific color. In a conventional RGB display, phosphor layer 175 may be selected from materials that produce red light, green light or blue light 195 when struck by electrons 140. As will be appreciated by those skilled in the art, the terms "light" and "photon" are used synonymously and interchangeably herein. A matrix organization of conductive pads and phosphor layers allows for X-Y addressing of each of the individual pixel elements in the display will be understood by one skilled in the pertinent arts.

Associated with each conductive pad 170/phosphor layer 175 pixel is a TFT circuit 180 and associated TFT final passivation layer 179, that serve to apply a known voltage to the associated conductive pad 170/phosphor layer 175 pixel. For example, TFT circuit 180 operates to apply either a first voltage to bias an associated pixel element to maintain it in an "off" state or a second voltage to bias an associated pixel element to maintain it in an "on" state, or an intermediate state. In this illustrated case, conductive pad 170 is inhibited from attracting electrons 140 emitted by cathode 104 when in an "off" state, and attracts electrons 140 when in an "on" state or an intermediate state.

The use of TFT circuitry 180 for biasing conductive pad 170 provides the dual function of addressing pixel elements and maintaining the pixel element in a condition to attract electrons for a desired time period, i.e. time-frame or subperiods of a time-frame. Cathode 104 is fabricated by progressively depositing onto substrate 110, conventionally a glass, an insulating material 115, such as a silicon dioxide ($SiO_2$), an edge emitter material 120 operable to emit electrons, a second insulating layer 125, such as $SiO_2$, and a second conductive material 130, such as Mo. Emitter material 120 may be selected from known materials that have a low work function for emitting electrons 140. Emitter material 120 may comprise a metal such as Molybdenum (Mo), for example. Wells 136 are formed through the deposited second conductive layer 130, insulating layer 125, emitter layer 120, and insulating layer 115 using well-known techniques, such as photo-etching. In this case, edges 135 of emitter material 120 are exposed and generate electrons 140 under excitation. Second conductive material 130 operates as a gate electrode to draw electrons 140 from the edges of emitter material 120 when a sufficient potential difference exists between conductive material 130 and emitter layer 120.

Figure 2:
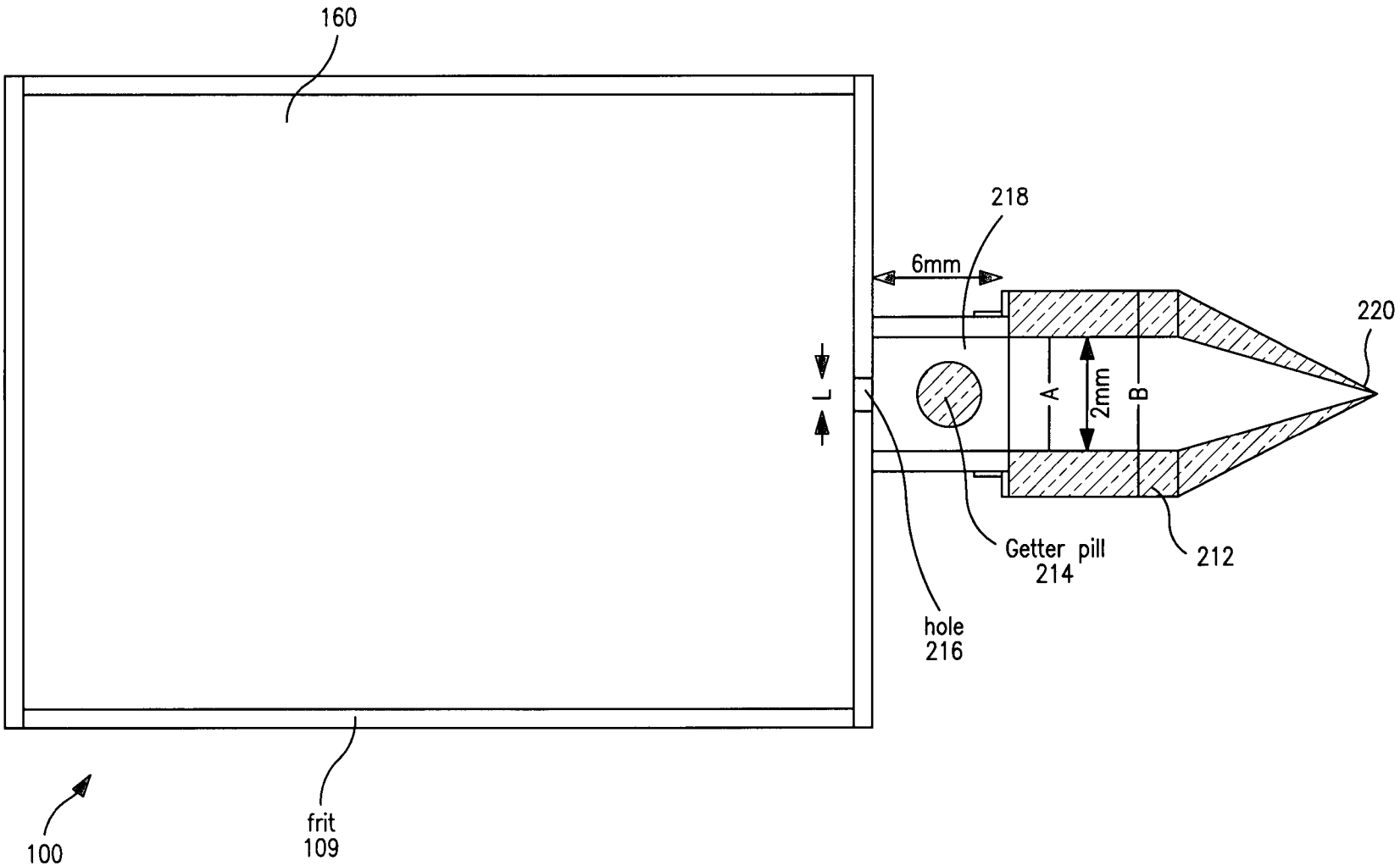
FIG. 2 illustrates a top view of a display device and a getter box and evacuation tube according to an embodiment of the present invention.

FIG. 2 illustrates a top view of the vacuum container 100 according to the present invention. As indicated through-hole 216 has a generally rectangular shape formed by the foreshortened sides and the top and bottom plates referred to as substrates 160 and 110 of the vacuum container 100. In the illustrated embodiment, the through-hole 216 is installed at the top end portion of the container 100 to provide for communication between getter box 218 via through-hole 216 and the vacuum container 100. The through-hole 216 has a width W of 0.2 mm and a length L which is greater than 60 mm, and preferably about 70 mm. The getter box 218 is placed over the (rectangular) hole 216 and sealed to the display as shown in FIG. 1*c*. The getter box opening 420 (FIG. 4A) is much longer than it is wide. This enables the 2 mm internal diameter evacuation tube to completely and rapidly evacuate the container 100.

Figure 3A:
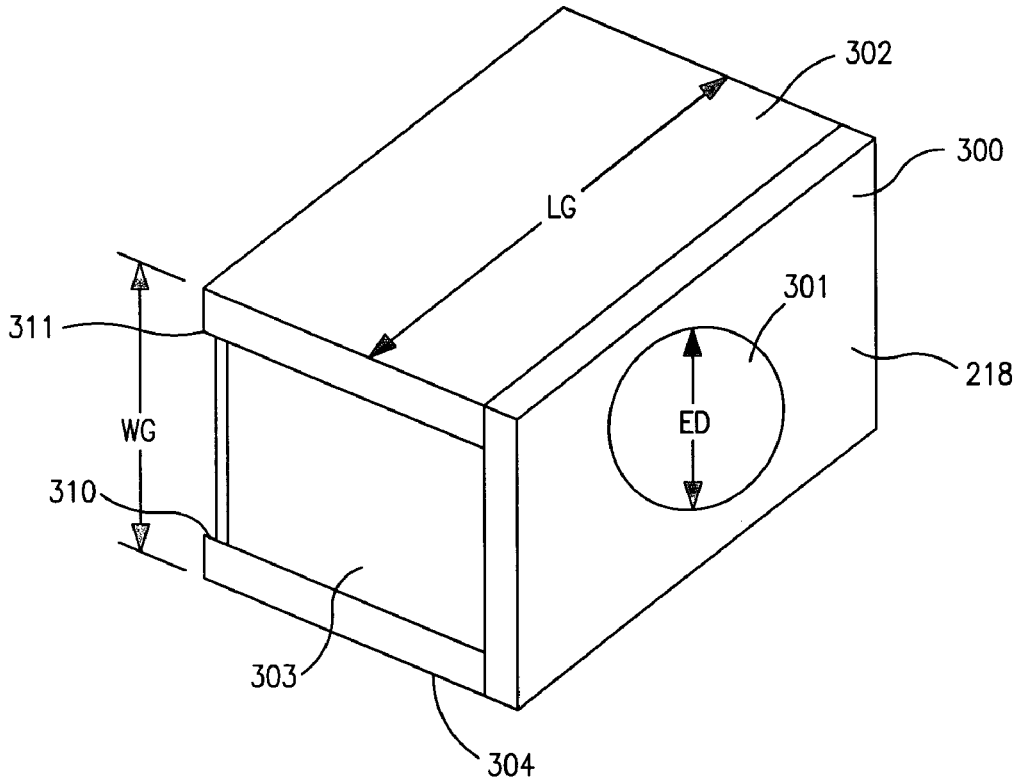
FIG. 3*a* illustrates a perspective view of an exemplary getter box according to an embodiment of the present invention.
Figure 3B:
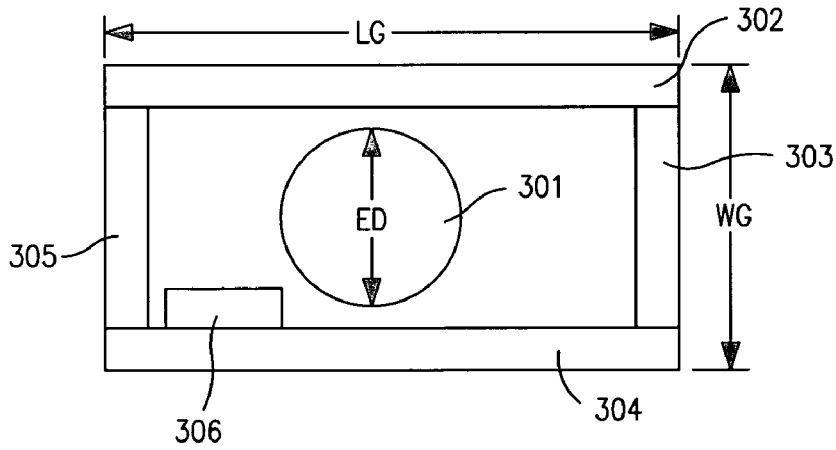
FIG. 3*b* shows a front view of the getter box of FIG. 3*a*.

Referring to FIGS. 3*a* and 3*b* there is shown a perspective view of a getter box 218 in FIG. 3*a* and a front view of the box in FIG. 3*b*. Essentially as shown in FIG. 3*a*, the getter box comprises a rectangular box having a front opening. The box may be fabricated by the use of thin glass plates such as 300, 302, 303 and 304. These plates may be joined together by glass frits or other well known techniques. In a similar manner other construction techniques of making the box can be implemented. As seen in FIG. 3*a*, the back surface of the box 218 has a circular aperture 301. This circular aperture 301 can be a little greater than 2 mm in order to accommodate the inner diameter (A) of the evacuation tube (see FIG. 1*c*). The evacuation tube can be sealed about the periphery of the aperture 301. In any event, as seen in FIG. 3*b*, the hole ED has a diameter of approximately 2 mm. There is also shown a getter pill 306 positioned within the getter box. As seen in FIG. 1*c* the getter box is positioned over the cathode and anode substrates by using the projecting ends 310 and 311 as shown in FIG. 3*a*. These ends as seen in FIG. 1*c* are then coupled (via glass frit) to the box as well as the end walls of members 303 and 305. The getter box has a length designated as LG of about 70 to 90 mm to accommodate the length of the aperture in the peripheral seal of 60 mm and has a width WG of greater than about 4 mm to allow the aperture 301 to be accommodated and to further enable easy securement to the cathode and anode substrates. The use of glass frit seals to secure glass parts together is extremely well known and such techniques are normally implemented by application of appropriate pressure and heat to the glass parts. The sealing of glass parts one to another, either to form the getter box 218 or to provide the seal between the anode and cathode substrates, are well known.

The getter pill 306 operates to chemically absorb the remaining gas in the envelope of the vacuum container 100 following the evacuation of gases by pumping means. The getter 306 may be installed in a space in the getter box 218 where the getter 306 is fixedly supported therein. As illustrated, the getter pill 306 is provided, on a portion of an inner surface of the getter box 218. There may be multiple getter pills 306 placed in the getter box 218.

Figure 4A:
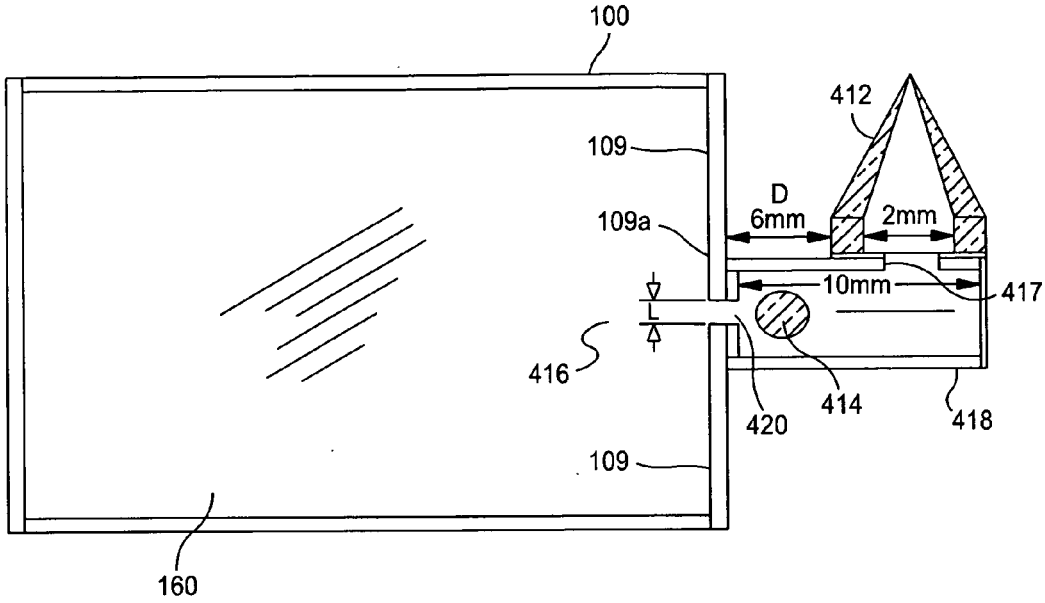
FIG. 4*a* illustrates a vacuum container and a getter box according to another embodiment of the present invention.
Figure 4B:
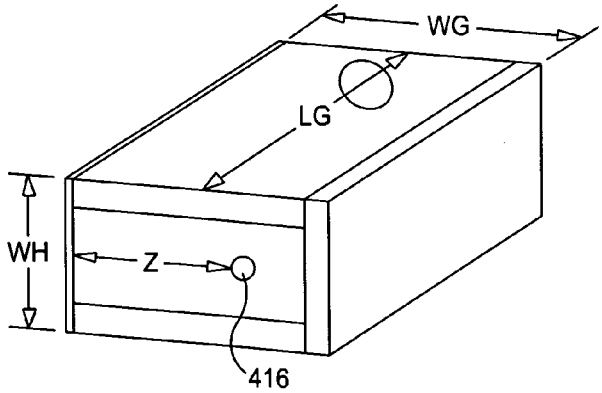
FIG. 4*b* shows a perspective view of the getter box of FIG. 4*a*.

Referring to FIG. 4*a*, there is shown a view of a display with an anode plate 160 secured by means of a glass frit seal 109 to a cathode plate or substrate not shown. As shown in FIG. 4*a* the getter box 418 now protrudes from the short side and has the evacuation tube 412 secured to a side of the getter box. The getter box 418 shown in FIG. 4*a* is different in orientation than the getter box shown in FIG. 1*c*. The getter box 418 is coupled to the anode and cathode substrates by the projecting ends of the getter box. The getter box 418 has the evacuation tube 412 extending from a side surface. The getter box 418 also contains a getter pill 414 and has an aperture 420 which coacts with the aperture 416 in the peripheral seal between the anode and cathode substrates. As indicated above, the length (L) of the aperture 416 is also approximately 60 mm while the width W (not shown) of the aperture is limited by the width of the seal between the anode and cathode which is indicative of the spacing there between. This dimension for W is again 0.2 mm. As seen in FIG. 4*a*, the getter box which has a length of approximately 70 mm extends over the aperture 416. The side of the getter box has an aperture 417 which aperture is 2 mm or slightly greater and which aperture accommodates the evacuation tube 412 as seen in FIG. 4*a*. Also as seen in FIG. 4*a*, the width of the getter box from the front of the display surface to the back of the getter box is 10 mm. The evacuation tube as indicated has inner diameter of 2 mm where the inner diameter coacts with the aperture 417. It has an outer diameter of 4 mm, with a wall thickness therefore of 1 mm. The evacuation tube 412 has one wall spaced a distance D of 6 mm from the front wall of the display. The thickness of the wail of the evacuation tube is approximately 1 mm, the inner diameter is 2 mm and therefore the total width of the getter box as shown in FIG. 4*a* is 10 mm. The length of the getter box which is shown in FIG. 4*b* as LG is approximately 70-80 mm to cover and enclose the 60 mm aperture. The width of the getter box WG as indicated is 10 mm, with the height of the getter box WH varying as a function of the thickness of the glass substrates comprising the anode and cathode.

Typically the front surface of the getter box as shown in FIG. 4*a* can be directly coupled to the front surfaces of the anode and cathode substrates by utilization of a glass frit. Therefore the WH or the height of the getter box can be for example 2.5 mm. If the getter box were 2.5 mm in height, the internal aperture of the getter box would have to interface with the 0.2 mm aperture. If the cathode and anode plates were each 1 mm thick then the surfaces of the getter box in the front would coact with surfaces of the anode and cathode allowing it to be secured thereto by means of a glass frit. Also shown in FIG. 4*b* is the aperture 416 which basically is shown in FIG. 4*a* as aperture 417. The aperture 416 receives the evacuation tube 412. As seen in FIG. 4*a* the aperture 416 is dimensioned to accommodate the evacuation tube and is slightly greater than the inner diameter of 2 mm of the evacuation tube. In any event, this difference is insignificant as the evacuation tube operates to efficiently withdraw the air between the cathode and anode substrates and to create an efficient vacuum there between.

As seen in FIG. 4*b* the getter box can be fabricated from separate glass plates which are joined together by glass frits. Fabrication of getter boxes or glass boxes from glass members is known in the art.

It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A vacuum container comprising;

a first and second substrate of relatively the same dimensions and areas;

a peripheral sear positioned about the outer periphery of each substrate for bonding said first substrate to said second substrate to form a composite stacked member of a given height with said first substrate bonded to said second substrate with said seal sandwiched between said substrates, said substrates separated one from the other by the width of said seal to create an internal hollow between said substrates, said seal having an elongated aperture between said substrates;

a getter box having a top and a bottom surface with a first and a second side joining said top and bottom surfaces, with a front opening of said box having a length greater than the length of said aperture and a width greater than the thickness of the composite member and the height of said box is larger than the height of said composite member, said box joined to said substrates to cover and enclose said aperture in said seal wherein said box has extending projections to overlie said first and second substrates to secure said box to said substrates by joining said projections to said substrates with a glass bond, said box having a vacuum aperture in one side with an evacuation tube of a given diameter opening to enclose said vacuum aperture, said tube joined to said box about said opening and having a sealed end remote from said box, said getter box having a getter source in said box hollow to absorb any residual gasses in said display hollow after said display hollow has been evacuated to a desired vacuum before sealing said end of said evacuation tube, wherein the area of the aperture is equal to or greater than $\pi(D/2)^2$ where D is the diameter of the evacuation tube opening.

2. The vacuum container according to claim 1, wherein said first and second substrates are glass substrates of the same size and thickness.

3. The vacuum container according to claim 2, wherein said peripheral seal is a glass seal spacing said first substrate from said second substrate at a predetermined distance.

4. The vacuum container according to claim 2, wherein said substrates are rectangular and of the same size.

5. The vacuum container according to claim 4, wherein said predetermined distance is less than 0.5 mm.

6. The vacuum container according to claim 5, wherein said aperture width is less than 0.5 mm.

7. The vacuum container according to claim 6, wherein said aperture length is between 60 to 80 mm.

8. The vacuum container according to claim 2, wherein each substrate is of the same thickness and selected between 0.5 mm to 1.5 mm.

9. The vacuum container according to claim 2, wherein each substrate is 0.7 mm thick.

10. The vacuum container according to claim 1, wherein said evacuation tube opening has a diameter of D with and area equal to $\pi(D/2)^2$, with said aperture having a length L and a width W where the area of L×W is approximately equal to $\pi(D/2)^2$ the area of the evacuation tube opening.

11. The vacuum container according to claim 1, wherein said first substrate is the anode substrate of a fiat panel display (FPD) and with said second substrate being the cathode substrate of said display.

12. The vacuum container according to claim 11, wherein said display is a TFT anode/cold cathode FPD display.

13. The vacuum container according to claim 1, wherein said first substrate is a glass substrate for viewing and said second substrate is at least one of an anode substrate and cathode substrate of a flat panel display (FPD).

14. The vacuum container according to claim 1, wherein said getter source is one of an elongated getter strip and a getter pill.

15. The vacuum container according to claim 1, wherein said getter box is symmetrically disposed about said seal aperture.

16. The vacuum container according to claim 1, wherein said getter box is rectangular in shape.

* * * * *